United States Patent [19]

Ross

[11] 4,328,624

[45] May 11, 1982

[54] CLAMP FOR MOUNTING TELESCOPIC PISTOL SIGHTS

[75] Inventor: Cecil J. Ross, El Paso, Tex.

[73] Assignee: W. R. Weaver Company, El Paso, Tex.

[21] Appl. No.: 149,799

[22] Filed: May 14, 1980

[51] Int. Cl.[3] ..... F41G 1/38

[52] U.S. Cl. ..... 33/245; 42/1 ST

[58] Field of Search ..... 33/245, 246, 247, 248, 33/249, 250; 42/1 ST; 248/310, 316 B, 316 C, 316 D, 316 E

[56] References Cited

U.S. PATENT DOCUMENTS

| | | | |
|---|---|---|---|
| 1,009,282 | 11/1911 | Cobb | 33/245 |
| 2,426,812 | 9/1947 | Bennett | 33/245 |
| 3,172,941 | 3/1965 | Norman | 33/245 |
| 3,292,264 | 12/1966 | Kincannon | 33/245 |
| 3,992,783 | 11/1976 | Dunlap et al. | 33/250 |

FOREIGN PATENT DOCUMENTS

| | | | |
|---|---|---|---|
| 140299 | 4/1949 | Australia | 33/246 |
| 370434 | 3/1923 | Fed. Rep. of Germany | 33/245 |
| 1279511 | 10/1968 | Fed. Rep. of Germany | 33/250 |

OTHER PUBLICATIONS

Krentz, "Scope Your Handgun for Higher Scores", *The American Rifleman*, Jun. 1974, pp. 34 and 35.

Milek, "Scope Your Way to Handgun Accuracy", *The American Rifleman*, Jan. 1972, pp. 35–38.

*Primary Examiner*—Richard R. Stearns

*Attorney, Agent, or Firm*—William W. Jones; Paul J. Lerner

[57] ABSTRACT

This mounting assembly is particularly adapted for mounting telescopic sights on pistols. The mount base is secured to the pistol at its breechward end by a screw which is threaded into a tapped hole in the pistol, which tapped hole is conventionally formed at the factory and is standard on pistols. The muzzleward end of the mount base is secured to the pistol barrel or pistol frame by means of a clamp. A screw is threaded into the clamp and tightens the clamp against the mount base. The mount base is provided with opposed surfaces which are forced against complementary surfaces on the clamp to tighten the clamp about the barrel or frame of the pistol when the clamp is tightened against the base.

3 Claims, 7 Drawing Figures

CLAMP FOR MOUNTING TELESCOPIC PISTOL SIGHTS

This invention relates to a telescopic gunsight mounting assembly which is adapted for securing a scope to a pistol. More particularly, the mounting assembly of this invention is of the clamping type which includes a portion which clamps onto the pistol barrel or pistol frame.

The utility of a pistol for target shooting or hunting can be greatly enhanced when the pistol is fitted with a telescopic gunsight. The relatively small size of a pistol, however, complicates the problem of fitting it with a scope mount system. Some models of Ruger and Colt handguns are provided at the factory with a single tapped hole at the rear of the top strap, which hole is used for mounting a rear iron sight on the pistol. These manufacturers do not recommend the drilling and tapping of additional holes in the frame or barrel of the pistol because of the real possibility of damaging or rendering the pistol unsafe. Thus, with such handguns, the only viable way to secure a scope to the pistol is by clamping the mount assembly to the pistol frame or barrel.

A number of scope mounting assemblies have been devised which utilize a clamp or clamp-like member to provide securement of the mount to the firearm. These mounting assemblies generally have in common the use of a threaded bolt which is used to tighten the clamp, with the bolt axis being generally parallel to the tightening and loosening direction of the clamp. These mounts are generally cumbersome, unattractive, and of relatively complicated construction. Illustrative of prior art scope mounting systems utilizing clamping means of one sort or another are the systems shown in U.S. Pat. Nos. 660,361 to C. Candrian (1900); 1,009,282 to L. H. Cobb; 2,426,812 to P. G. Bennett; 3,172,941 to J. B. Norman; 3,235,967 to R. J. Moure et al.; 3,260,001 to W. R. Weaver; 3,292,264 to L. T. Kincannon; and 3,405,448 to R. E. Weatherby.

The scope mount assembly of this invention includes a base member which is secured to the breechward end of the pistol by means of a screw which is threaded into the factory tapped hole provided at the breechward end of the top strap of the pistol. A base key member is provided which is received in the rear sight slot of the pistol and is secured to the pistol by the breechward screw referred to above. The key operates to lock the base against lateral movement, and the key, or the rear of the cylinder frame may be used as a recoil ad for the scope and mount assembly. At the muzzleward end of the base there is secured to the base by means of a threaded bolt, an open bottom clamp. The clamp is contoured to fit about the barrel or frame, as the case may be. The threaded bolt is journaled in the base and threaded into the clamp so that when the bolt is tightened, the clamp is pulled tightly against the underside of the base, or an additional plate member butted thereagainst. The underside of the base, or the plate member, as the case may be, is provided with laterally opposed pressure surfaces which bear against complimentary surfaces on the clamp. The mid portion of the underside of the base is spaced apart from the corresponding mid portion of the clamp so that, as the bolt is tightened, the clamp is pulled tightly against the base whereby the pressure surfaces bearing on the clamp's complimentary surfaces cause the clamp to be deformed radially inwardly thereby exerting a clamping force on the frame or barrel of the pistol, as the case may be. The inherent springiness of the material from which the clamp is made, such as steel, results in radially outward deflection of the clamp when the bolt is loosened.

It is, therefore, an object of this invention to provide an improved telescopic gunsight mounting assembly which is particularly suited for securement to a handgun.

It is a further object of this invention to provide a scope mounting assembly of the character described which comprises a clamping member adapted to be clamped to the frame or barrel portion of the handgun.

It is an additional object of this invention to provide a scope mounting assembly of the character described which is of simplified construction which ensures a positive clamping engagement with the handgun when mounted thereon.

These and other objects and advantages of the invention will become more readily apparent from the following detailed description of several preferred embodiments thereof when taken in conjunction with the accompanying drawings, in which.

Figure 1:
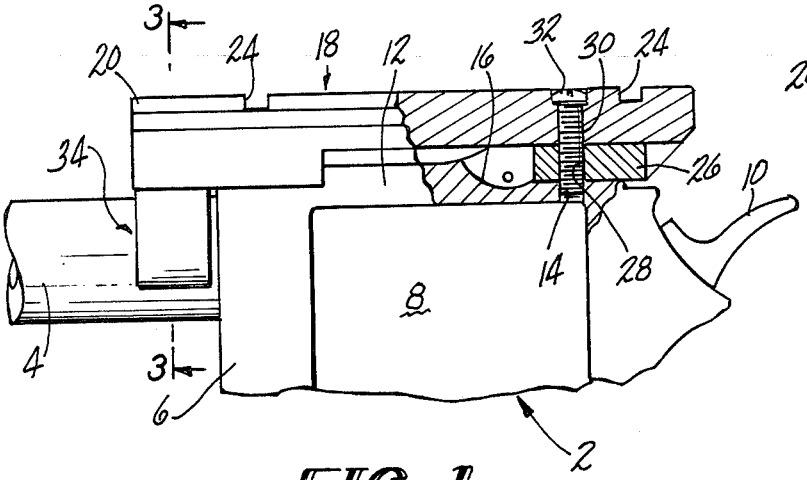
FIG. 1 is a fragmented side elevational view, partially in section, of a portion of a pistol showing a preferred embodiment of a scope base and clamp mounted thereon, the clamp being secured to the pistol barrel.

Referring now to the drawings, there is shown in FIG. 1 the pertinent portion of a pistol, denoted generally by the numeral 2, upon which a telescopic gun sight is mounted. The pistol 2 includes a barrel 4, a frame 6, a revolving cylinder 8 mounted in the frame 6, and a hammer 10 at the breech end of the pistol 2. The frame 6 includes an upper portion 12 which is referred to in the trade as the top strap. The top strap 12 has a tapped hole 14 at its breechward end, which hole 14 is provided by the factory and is a standard feature for use in securing a rear iron sight to the pistol 2. The hole 14 is located in the bottom of a slot 16 which, again, is a standard factory feature.

Figure 2:
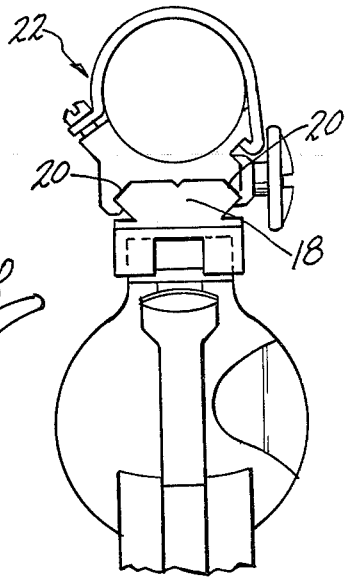
FIG. 2 is an end elevational view of the device shown in FIG. 1 taken from the breech end of the pistol and looking toward the muzzle end thereof, the scope rings also being shown.

The mount assembly includes a base 18 which has V-shaped lateral sides 20, the base 18 serving to clampingly receive the saddle and rings subassemblies 22 which, in turn, hold the scope (see FIG. 2). Lateral slots 24 are formed in the upper surface of the base 18 for reception of locking bolts on the saddle and ring subassemblies 22, which resist recoil forces imposed on the scope when the pistol is fired. A key block 26 is positioned in the slot 16, the key block 26 having a hole 28 extending through it in alignment with the tapped hole 14. The base 18 has a corresponding hole 30 extending through it in alignment with the key block hole 28 and the tapped hole 14. A bolt 32 having its distal end threaded extends through the aligned holes 28 and 30 and is screwed into tapped hole 14 so as to secure the breechward end of the base 18 to the top strap 12 of the pistol 2.

The muzzleward end of the base 18 is secured to the barrel 4 of the pistol 2 in the following manner, which will be clarified by reference to FIGS. 3 and 4. The clamp 34 is generally C-shaped and includes two-side clamping legs 36 and 38, the leg 38 being shortened to clear the ejector housing on the pistol. It will be noted that the clamping legs 36 and 38 are adjacent to the sides of the barrel 4, and the clamp 34 further includes a bridge portion 40 extending over the top of the barrel 4. The bridge 40 is provided with a threaded opening 42 extending therethrough, and a slot 43 (see FIG. 4) to facilitate bending of the bridge 40. Extending axially along the sides of the bridge 40 are a pair of recessed steps 44 and 46 against which are seated protruding side flanges 48 and 50 formed on the underside of the base 18. The flanges 48 and 50 depend downwardly from the underside of the base 18 a distance which is large enough to ensure that a gap exists between the bottom surface 52 of the base 18 and the top surface 54 of the bridge 40 when the flanges 48 and 50 are in contact with the steps 46 and 44 respectively. The base 18 is provided with a through hole 56 through which extends a threaded bolt 58, which bolt 58 is threaded into the threaded opening 42 in the clamp 34. The bolt 58 has an enlarged head 60 which bears against a radial shoulder 62 in the through hole 56 in the base 18.

The mount assembly is attached to the pistol 2 as follows: The base 18 and loosely-attached clamp 34 are slid over the muzzle end of the pistol 2 with the clamp 34 being upside down so as to clear the front sight of the pistol 2. The assembly is then righted and the key block 26 is placed in the slot 16 whereupon the holes 14, 28 and 30 are aligned. The bolt 32 is then inserted and tightened down to secure the breechward end of the base 18 to the pistol 2. The front bolt 58 is then tightened. This tightening causes the clamp 34 to be drawn up tightly against the underside of the base 18. When the clamp 34 is then drawn tightly against the base 18, the flanges 48 and 50 press down on the respective recessed steps 46 and 44. Since the gap between the lower surface 52 of the base 18 and the upper surface 54 of the clamp bridge 40 remains unclosed, as the bolt 58 is tightened, pressure on the steps 46 and 44 causes bending of the bridge 40 due to the slot 43, resulting in inward deflection of the legs 36 and 38 whereby the legs 36 and 38 tightly grip the sides of the barrel 4. In this manner, the muzzleward end of the base 18 is secured to the pistol 2. Total securement of the base 18 to the pistol 2 is thus established. The scope (not shown) may now be attached to and detached from the fixed base 18 by means of the ring clamps 22.

Figure 5:
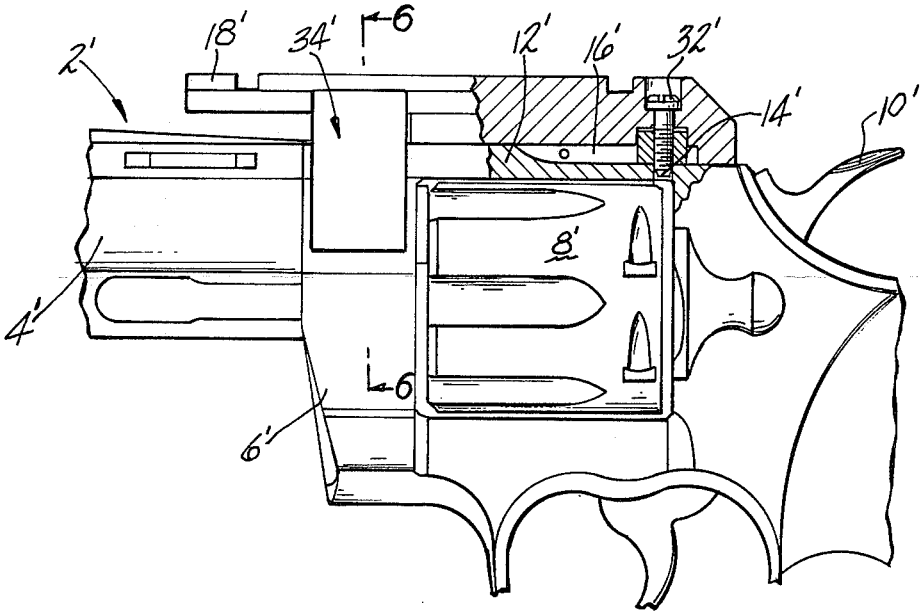
FIG. 5 is a side elevational view of a second embodiment of a scope mount assembly made in accordance with this invention and mounted on a pistol, shown fragmented, the clamp part of this embodiment being secured to the frame of the pistol.
Figure 6:
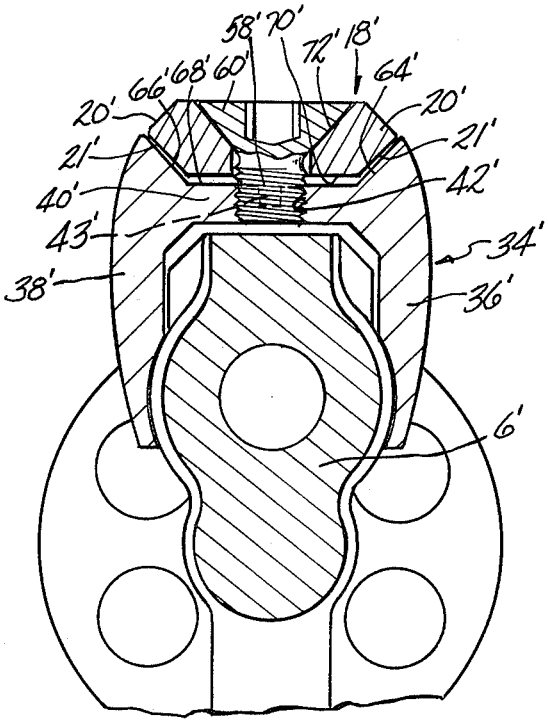
FIG. 6 is a sectional view of the clamp part taken along line 6—6 of FIG. 5.
Figure 7:
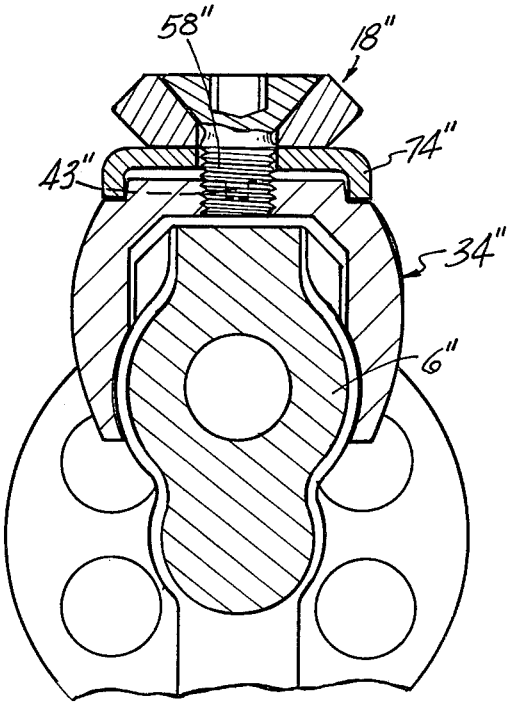
FIG. 7 is a sectional view, similar to FIG. 6 showing a modified assemblage for actuating the clamp.

Referring now to FIGS. 5 and 6, there is shown a modified embodiment of the mounting assembly of this invention which is adapted to be clamped to the frame of a pistol 2'. In referring to the embodiments of FIGS. 5, 6 and 7, comparable parts of the mounting assembly will be identified by primed numbers. The pistol 2' includes a barrel 4', a frame 6', a cylinder 8', and a hammer 10'. At the breechward end of the top strap 12' there is disposed a slot 16' and in the bottom of the slot 16' there is a tapped hole 14'. The base 18' is secured to the pistol 2' by means of a threaded bolt 32' at the breechward end of the base 18', and by means of a clamp 34' at the muzzleward end. It will be noted that the clamp 34' grips the frame 6' rather than the barrel 4 in the embodiments of FIGS. 5–7.

Referring to FIG. 6, it will be noted that the clamp 34' is formed with opposing legs 36' and 38' and an intermediate bridge portion 40'. The upper surface of the bridge 40' is generally concave or channelled and includes opposed outer upwardly and outwardly extending surfaces 64' and 66' and a central laterally extending flat portion 68'. A threaded aperture 42' extends through the bridge 40', and a slot 43' is cut into the top surface of the bridge 40'. The base 18 is formed with the V-shaped lateral sides 20' with the lowermost surface 21' of each side 20' engaging the surfaces 64' and 66' of the clamp 34'. It will be noted that a slightly different angle of taper is found on the abutting surfaces 21' and 64' and 66' so that actual contact therebetween is established at the outermost part of the surfaces 64' and 66'. It will be noted that a gap is maintained between the upper surface 68' of the bridge 40' and the lower surface 70' of the base 18'. A tightening bolt 58' is threaded into the threaded aperture 42' so that when the bolt 58' is tightened into the aperture 42',engagement between the threads, and between the bolt head 60' and countersink 72' in the base 18' causes the base 18' and clamp 34' to be drawn tightly together. This results in increased pressure at the contact area between the surfaces 21' and surfaces 64' and 66' results in bending of the bridge 40' due to the slot 43', whereby the legs 36' and 38' are drawn inwardly into tight gripping contact with the frame 6'.

Figure 3:
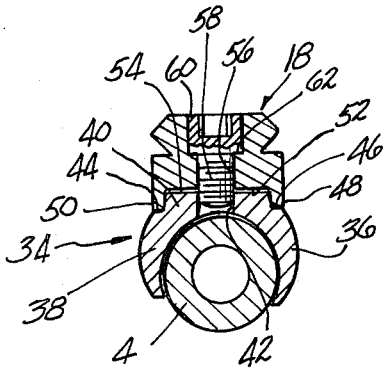
FIG. 3 is a sectional view of the clamp part of the mount taken along line 3—3 of FIG. 1.
Figure 4:
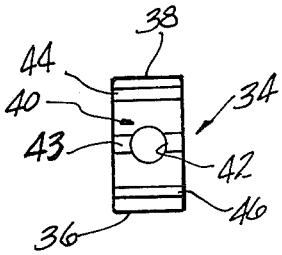
FIG. 4 is a top plan view of the clamp part of the mount assembly of FIG. 1.

Reference is now made to FIG. 7'', which is a modified form of a clamping structure shown in FIG. 3'', but wherein the clamp 34'' is adapted to grip the frame 6'' of the pistol rather than the barrel. In the embodiment of FIG. 7'' a fulcrum plate 74'' is interposed between the base 18'' and the clamp 34'' so that when the bolt 58'' is tightened, the fulcrum plate 74'' imparts the gripping pressure to the clamp 34''.

It will be readily appreciated that the scope mount assembly of this invention is of relatively simple construction and can be used to firmly secure a pistol scope to a pistol. The existing rear sight mount hole and slot are used in conjunction with a positively gripping clamp for the pistol frame or barrel. No additional drilling or tapping of the pistol need be performed to secure the mount.

Since many changes and variations of the disclosed embodiments of the invention may be made without departing from the inventive concept, it is not intended to limit the invention otherwise than as required by the appended claims.

What is claimed is:

1. A mount assembly for securing an optical gunsight to a handgun said assembly comprising:

a. an elongated base member adapted to receive gunsight-engaging ring and saddle members;

b. means for securing a breechward end of said base member to the handgun;

c. a clamp member, carried by said base member, having lateral clamping legs arranged to be deflected toward each other to clampingly engage a frame or barrel portion of the handgun;

d. pressure means, on said base member, engaging said clamp member for causing clamping deflection of said clamping legs when said clamp is drawn tightly against said pressure means; and e. adjustable tightening means for drawing said clamp member tightly against said pressure means in a direction perpendicular to the direction of deflection of said clamping legs, said tightening means comprising a threaded opening in said clamp member, and a threaded bolt threaded into said threaded opening and engaging said base member for drawing said clamp member toward said base member.

2. A mount assembly for securing an optical gunsight to a handgun, said assembly comprising:

(a) a base member for overlying an upper surface on the handgun;

(b) means for securing a breechward end of said base member to a handgun;

(c) a clamp member having lateral clamping legs arranged to be deflected toward each other to clampingly engage a frame or barrel portion of the handgun, said clamp member also including a bridge portion extending between said clamping legs and underlying said base member;

(d) pressure means overlying said clamp member and engaging opposite side portions of said clamp member above said clamping legs; and (e) adjustable tightening means engaging said base member and said clamp member for drawing said clamp member toward said base member to cause said pressure means to deflect said clamping legs toward each other.

3. The mount assembly of claim 2, wherein said tightening means comprises a bolt threaded into said bridge portion and operative to tighten said clamp member against said pressure means.

* * * * *